United States Patent [19]

Tanski

[11] 4,445,301

[45] May 1, 1984

[54] ROOF AND GUTTER SAVING DEVICE

[76] Inventor: James A. Tanski, 8621 Lochdale, Dearborn Heights, Mich. 48127

[21] Appl. No.: 397,844

[22] Filed: Jul. 13, 1982

[51] Int. Cl.[3] ..... E04D 3/12

[52] U.S. Cl. ..... 52/11

[58] Field of Search ..... 52/11, 12; 248/48.1, 248/48.2

[56] References Cited

U.S. PATENT DOCUMENTS

| | | | |
|---|---|---|---|
| 846,238 | 3/1907 | O'Dowd | 52/11 |
| 2,271,081 | 1/1942 | Layton | 248/48.2 |
| 2,672,832 | 3/1954 | Goetz | 248/48.1 |
| 2,935,954 | 5/1960 | Matthews et al. | 52/12 |
| 2,988,226 | 6/1961 | Campbell | 52/12 |
| 3,053,393 | 9/1962 | McLean | 52/12 |
| 3,295,264 | 1/1967 | Olson | 52/12 |
| 3,436,878 | 1/1969 | Singer | 248/48.2 |
| 3,507,396 | 4/1970 | Homa | 52/12 |
| 4,254,595 | 3/1981 | Crosslen | 52/95 |
| 4,286,418 | 9/1981 | Snyder | 52/105 |

*Primary Examiner*—John E. Murtagh

[57] ABSTRACT

This device serves to prevent ice from building up in the gutters of houses and pulling the gutters away, and it also prevents water from entering the structure when the ice building up in the gutter starts to force its way under shingles and roofing boards. Primarily, it consists of a plastic main body, having a tongue portion for insertion underneath the lowest shingles, and the main body covers the gutter. It further includes a stabilizing tab for support within the gutter, and an overhang portion of the main body lets the snow and water run off, away from the gutter.

1 Claim, 5 Drawing Figures

ROOF AND GUTTER SAVING DEVICE

This invention relates to protective devices for building structures, and more particularly, to a roof and gutter saving device.

The principal object of this invention is to provide a roof and gutter saving device, which will protect gutters of houses from becoming ice-filled during winter, and being pulled away from, or completely off, of a house or a garage, and it will eliminate any possibility of water entering the structure by means of ice building up in the gutter, and forcing its way under shingles and roofing boards.

Another object of this invention is to provide a roof and gutter saving device, which will prevent ice from building up in gutters, regardless of the amount of snow which has fallen, or the number of freeze and thaw cycles.

It is well known, that prolonged exposure of a roof of snow to the warm rays of the sun can also cause a tremendous melt, even if temperatures are actually below freezing. As the water cascades down shingles, it accumulates in the already ice-filled gutters, and the excess begins to seep under shingles and under roof boards.

Another object of this invention is to provide a roof and gutter saving device, which will act as an extension of the roof during the abovementioned critical times, and potential threats from ice and water will not be allowed to materialize.

A further object of this invention is to provide a roof and gutter saving device, which will be safe in use.

Other objects are to provide a roof and gutter saving device, which is simple in design, inexpensive to manufacture, rugged in construction, easy to use, and efficient in operation. These, and other objects, will be readily evident, upon a study of the following specification, and the accompanying drawing, wherein.

Figure 1:
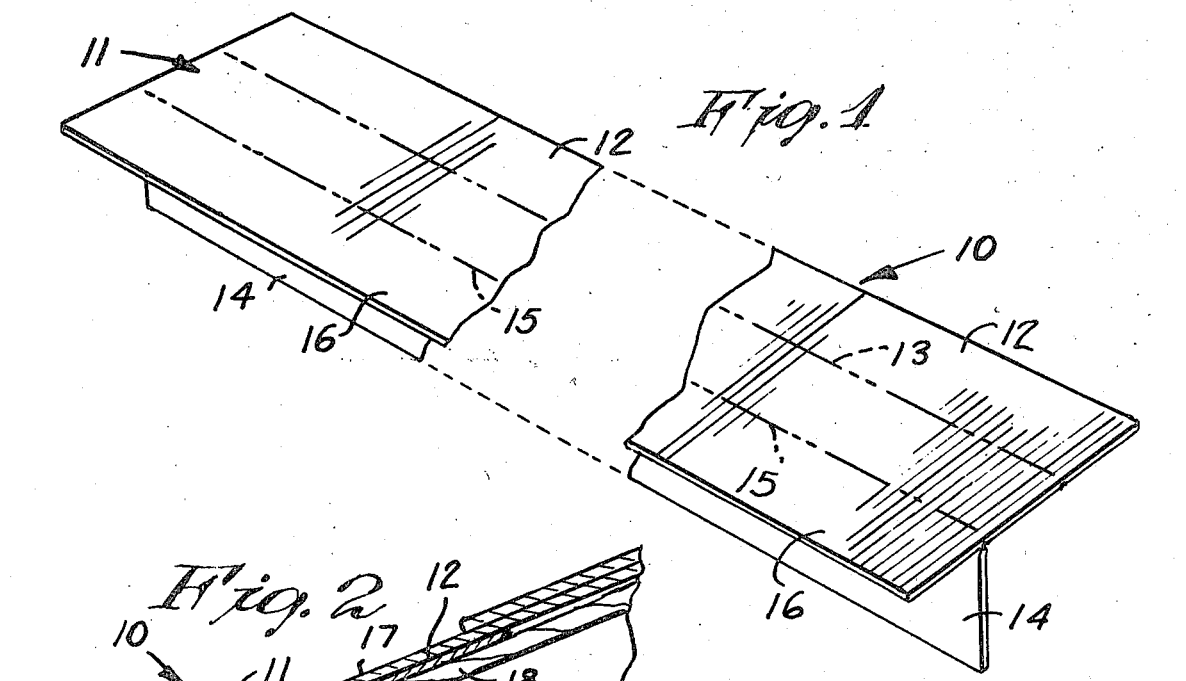
FIG. 1 is a perspective view of the present invention, shown partly broken away.
Figure 2:
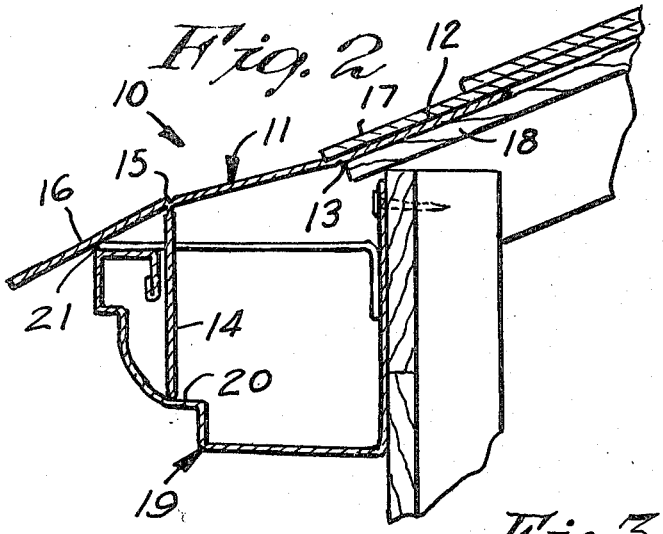
FIG. 2 is a cross-sectional view of FIG. 1, shown installed over a roof gutter, which is shown in section, as is the roof and the building structure.

According to this invention, a device 10 is shown to include a central and elongated main body 11, fabricated of a suitable plastic material. A tongue portion 12 is secured to main body 11, by a non-rigid joint 13 at a longitudinal side edge, and a stabilizing tab 14 is fixedly secured, at one longitudinal side edge, to a second non-rigid joint 15, forming the opposite longitudinal side edge of main body 11. An overhang portion 16 is also secured to the joint 15 at one longitudinal side edge, and portions 12, 16 and also tab 14 are fabricated of plastic as a whole of main body 11, for a purpose which hereinafter will be described.

In use, the tongue portion 12 of the device 10, which are used in plurality, is placed between the lower shingles 17 and the roof boards 18 of the roof. The main body 11 is then bent slightly upward along the joint 13. After the above is accomplished, the stabilizing tab 14 is folded downward, and seated at its free edge on the inside surface 20 of gutter 19. Once seated, the overhang portion 16 is pulled snugly forward, which will overhang the front edge 21 of the gutter 19.

In areas where spikes and ferrules are supporting gutters, the user simply trims the tab 14 slightly wider than the ferrule and the height of the tab 14, to adequately secure the device 10.

In cases where gutters wider than standard are encountered, the tongue portion 12 is simply pulled out slightly, to accommodate the width. If a steeply pitched roof is the case, the non-rigid joint 13 will easily conform to the required angle, upon correct placement of the tongue portion 12, and, in situations where a narrower gutter 19 needs protection, the user simply pushes the tongue 12 a little deeper under the shingles 17.

It shall also be noted, that device 10 can be used around the entire perimeter of a house to protect the gutters, or it can be used on a particular area where perhaps the insulation under the roof is not sufficient. In the above mentioned, escaping heat will cause rapid melting, and subsequent water and ice damage.

Figure 3:
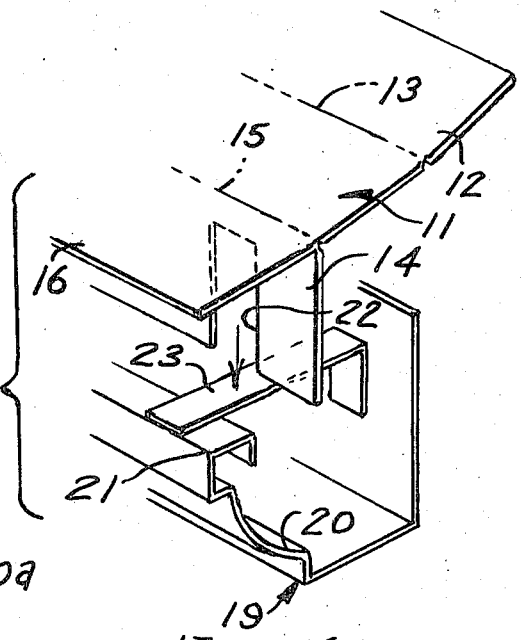
FIG. 3 is a fragmentary perspective view, showing a cut-out in the stabilizer tab of the invention, for clearing a crossband of a gutter.

It shall further be noted, that device 10 may also be employed on the side of a house where the sun shines most, and looking now at FIG. 3 of the drawing, the stabilizer tab 14 may include a cut-out opening 22, for receiving a crossband 23 of a gutter 19.

Figure 4:
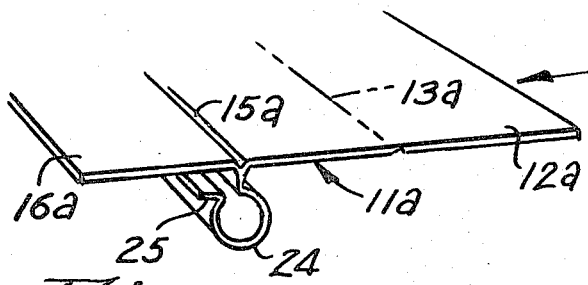
FIG. 4 is a perspective view of a modified form of the invention.
Figure 5:
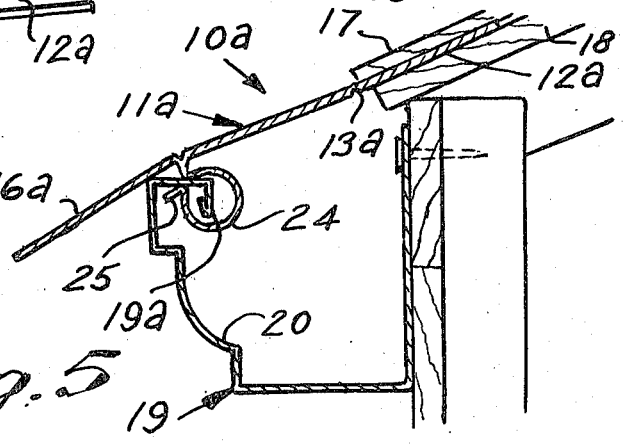
FIG. 5 is a cross-sectional view of FIG. 4, shown installed over a gutter, the view being similar to FIG. 2.

Referring now to FIGS. 4 and 5 of the drawing, a modified form of device **10*a* is shown to include a main body 11*a*, which is joined, at one longitudinal edge, to a longitudinal edge of a tongue portion 12*a*, by a joint 13*a*. The opposite longitudinal edge is joined, by joint 15*a*, to overhang portion 16*a*, and is also joined to a longitudinal open loop 24, having a lip 25** extending its entire length.

In use, tongue portion **12*a* is inserted between shingles 17 and roof boards 18, in the same manner as was heretofore described of device 10. Main body 11*a* covers gutter 19, and loop portion 24 is snapped onto lip 19*a* of gutter 19, leaving the overhang portion 16*a* extending downward and outward from gutter 19**.

While various changes may be made in the detail construction, it is understood that such changes will be within the spirit and scope of the present invention, as is defined by the appended claims.

What I claim is:

1. A roof and gutter saving device, comprising, in combination, an elongated central main body, a tongue portion along one longitudinal edge of said central main body and an overhang portion and a stabilizing tab along an opposite longitudinal edge of said central main body, a non-rigid joint formed along said longitudinal edges pivotally hinging said tongue portion, said overhang portion and said stabilizing tab thereto; and said stabilizing tab being bent into a longitudinally extending open loop for snap clipping around a downwardly inner, rear lip formed along a front outer edge of a roof gutter.

* * * * *